US005545035A

United States Patent [19]

Tsai

[11] Patent Number: 5,545,035

[45] Date of Patent: Aug. 13, 1996

[54] IGNITION DEVICE WITH AN AIR FAN

[76] Inventor: Chin-Lin Tsai, 3F, No. 94, Sec. 4, Chung Hsin Rd., San Chung City, Taipei Hsien, Taiwan

[21] Appl. No.: 445,773

[22] Filed: May 22, 1995

[51] Int. Cl.[6] ..... F23Q 7/12

[52] U.S. Cl. ..... 431/255; 431/352; 432/222

[58] Field of Search ..... 431/255, 352, 431/345, 158; 34/97; 432/222

[56] References Cited

U.S. PATENT DOCUMENTS

| | | | |
|---|---|---|---|
| 4,635,382 | 1/1987 | Bourdeau | 126/401 X |
| 4,800,654 | 1/1989 | Levin et al. | 126/401 X |
| 4,903,416 | 2/1990 | Levin et al. | 34/97 |
| 5,344,314 | 9/1994 | Zagoroff et al. | 432/222 X |
| 5,476,378 | 12/1995 | Zagoroff et al. | 432/222 |

*Primary Examiner*—Larry Jones
*Attorney, Agent, or Firm*—Bucknam and Archer

[57] ABSTRACT

An ignition device including a housing, which is formed of an upper shell, a bottom shell, and a partition plate longitudinally connected between the upper shell and the bottom shell; a gas release device mounted within the housing and controlled to release a fuel gas for burning; a sliding control key device mounted on the housing and controlled to drive the gas release device, causing the gas release device to release the fuel gas, and to produce static sparks for burning the fuel gas; and a fan device mounted within an upright endless wall on the partition plate between the upper shell and the bottom shell and controlled by the sliding control key device to draw a flow of air into the housing, permitting the flow of air to be further guided out of the housing for accelerating the burning of the article been burnt by the ignition device.

12 Claims, 3 Drawing Sheets

IGNITION DEVICE WITH AN AIR FAN

BACKGROUND OF THE INVENTION

The present invention relates to fuel-gas operated ignition devices for making a flame for burning things, and relates more particularly to such an ignition device which has a fan device controlled to draw a flow of air for accelerating the burning of the object been burnt.

A variety of fuel-gas operated ignition devices have been disclosed for making a flame for burning things, and have appeared on the market. The common drawback of these fuel-gas operated ignition device is that the housing will become how quickly, causing the user unable to hold the device in hand. U.S. patent application Ser. No. 08/349,961 discloses an injection igniter with safety device, which was invented by the present inventor, comprising an igniter holder, a fuel storage compartment, a gas outlet device, a sleeve base and an ignition device assembled together and contained in a housing. When a push button is pressed, the button ring thereof is disengaged from a slot to cause a shield to move upward. A slide piece engaging with the shield is also caused to move upward so that its U-shaped slot pulls a gas nozzle upward to release gas. By pressing a piezo electric base, a piezo electric device is caused to generate static electricity which is transmitted by a lead wire leading to an injection nozzle for ignition. When the igniter is not in use, the shield is pushed downward so that the button ring retracts into the slot, causing the gas nozzle to be closed again. The fire will go out by itself when the residual gas in the gas outlet tube is totally burned. Other elements such a clip, a cap, a relay tube and an outer tube may be further included to enhance the functions of the igniter. This structure of injection igniter is functional. However, this structure of injection igniter has no fan means. Therefore, when an object is burnt, a fan device may be used separately used and controlled to produce a flow of air for accelerate the burning of the object.

SUMMARY OF THE INVENTION

The present invention has been accomplished to provide an ignition device which has a fan device that can be conveniently controlled by the ignition control sliding key of the device to produce a flow of air for accelerating the burning of the object been burnt. According to the preferred embodiment of the present invention, the ignition device comprises a housing, which is formed of an upper shell, a bottom shell, and a partition plate longitudinally connected between the upper shell and the bottom shell; a gas release device mounted within the housing and controlled to release a fuel gas for burning; a sliding control key device mounted on the housing and controlled to drive the gas release device, causing the gas release device to release the fuel gas, and to produce static sparks for burning the fuel gas; and a fan device mounted within an upright endless wall on the partition plate between the upper shell and the bottom shell and controlled by the sliding control key device to draw a flow of air into the housing, permitting the flow of air to be further guided out of the housing for accelerating the burning of the article been burnt by the ignition device.

DETAILED DESCRIPTION OF THE PREFERRED EMBODIMENT

Figure 1:
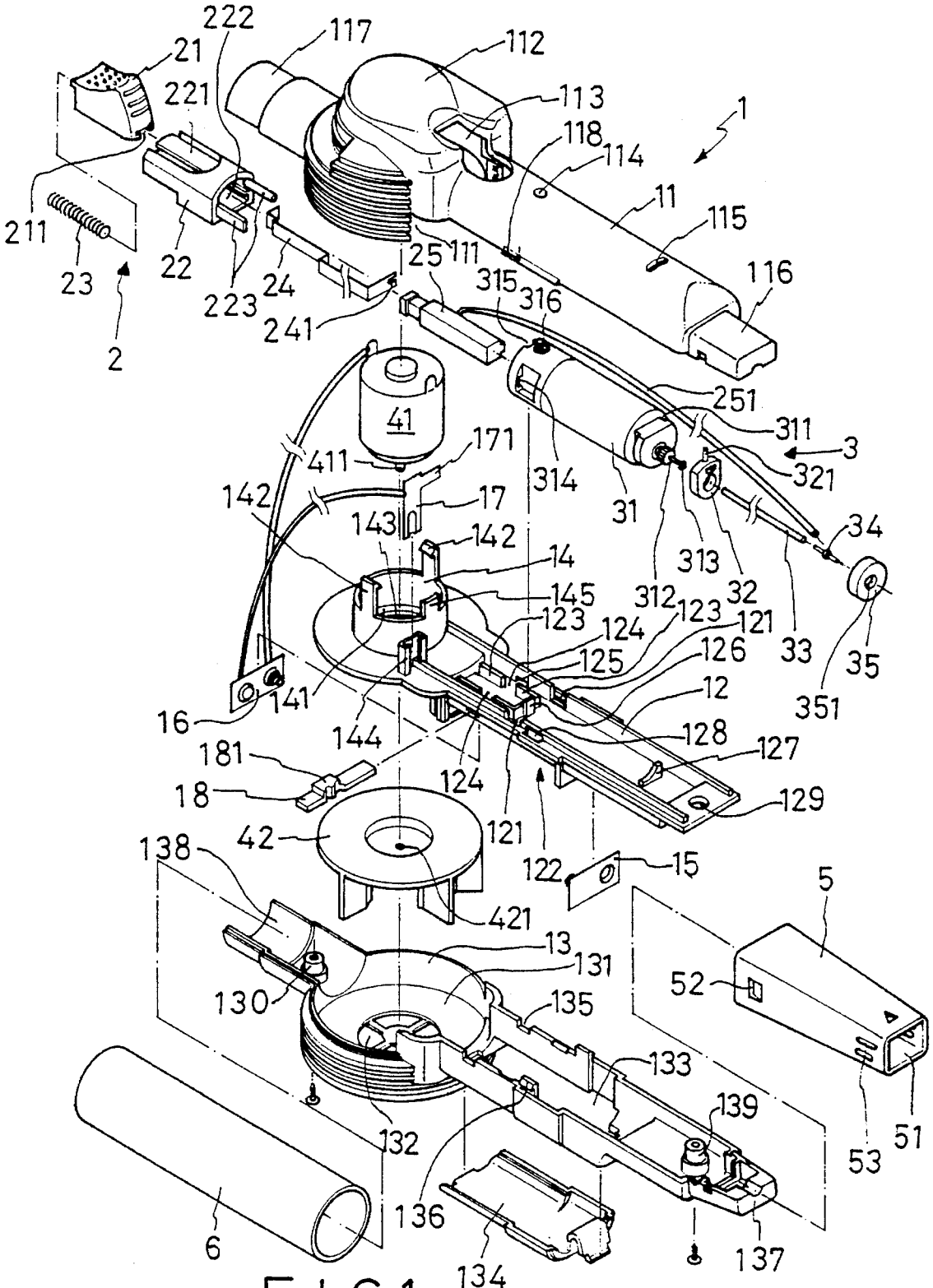
FIG. 1 is an exploded view of an ignition device according to the preferred embodiment of the present invention.

Referring to the annexed drawings in detail, an ignition device in accordance with the present invention is generally comprised of a housing 1, a sliding control key device 2, a gas release device 3, a fan device 4, a front socket 5, and an extension tube 6.

The housing 1 is comprised of an upper shell 11, a bottom shell 13, and a partition plate 12 longitudinally connected between the upper shell 11 and the bottom shell 13. The upper shell 11 comprises a front projection 116 at one end, a half-round rear projection 117 at an opposite end, a bottom chamber 111 between the front projection 116 and the half-round projection 117, a top slope 112 above the bottom chamber 111, a longitudinal sliding slot 113 in front of the top slope 112, through which a key 21 (which will be described further) extends out of the housing 1, an adjustment hole 115 in front of the longitudinal sliding slot 113, a through hole 114 spaced between the longitudinal sliding slot 113 and the adjustment hole 115, and two opposite bottom hooks 118.

The partition plate 12 fitting the upper shell 11, comprising a first pair of opposite retaining holes 121 at two opposite sides respectively hooked up with the bottom hooks 118 on the upper shell 11, an endless upright wall 14 corresponding to the bottom chamber 111 of the upper shell 11, an annular flange 141 raised from the inside wall of the endless upright wall 14 to support the motor 41 of the fan device 4, two opposite upward hooks 142 and an upward stop rod 145 respectively and upwardly extended from the topmost edge of the endless upright wall 14, an axle hole 143 defined within the endless upright wall 14 for the passing of the output shaft 411 of the motor 41, a channel-like upright support 144 disposed at one side by the endless upright wall 14 to hold a substantially L-shaped metal spring plate 17, permitting the contact end 171 of the L-shaped metal spring plate 17 to be spaced from the respective contact on the motor 41, a battery chamber 122 at the bottom side, two contact metal strips, namely, the first contact metal strip 15 and the second contact metal strip 16 at two opposite ends of the battery chamber 122 to hold a battery set (not shown) inside the battery chamber 122, a plurality of ribs 123 disposed in front of the endless upright wall 14 and defining two opposite spaces 124, two opposite side notches 125 at two opposite sides by the ribs 123, a safety plate 18 having two opposite ends respectively inserted the spaces 124 into the through holes 125 and a raised stop portion 181 in the middle for stopping the key 42, a front mounting hole 129, which receives the upright mounting rod 139 of the bottom shell 13, an upright locating rod 126 and a curved mounting strip 127 spaced between the ribs 124 and the front mounting hole 129 to hold a fuel gas container 31, and a second pair of opposite retaining holes 128 for mounting the bottom shell 13. The second contact metal strip 16 is electrically connected between one end of the motor 41 and the L-shaped metal spring plate 17.

The bottom shell 13 fits the upper shell 11, comprising a top chamber 131 corresponding to the bottom chamber 111 of the upper shell 11, an air input port 132 through the bottom side of the bottom chamber 111 for letting air in, an opening 133 corresponding to the battery chamber 122 on the partition plate 12, a battery lid 134 closed on the opening 133, a front projection 137 matched with the front projection 116 of the upper shell 11, a front upright mounting rod 139 fitted into the front mounting hole 129 on the partition plate 12 and fastened to the upper shell 11 by a respective screw, two upright hooks 136 respectively hooked on the second pair of opposite retaining holes 128 on the partition plate 12, a rear half-round projection 138 matched with the rear half-round projection 117 of the upper shell 11, two opposite side notches 135 corresponding to the side notches 125 on the partition plate 12 for mounting the safety plate 18, and a rear upright mounting rod 130 fastened to the upper shell 11 by a respective screw.

Figure 3:
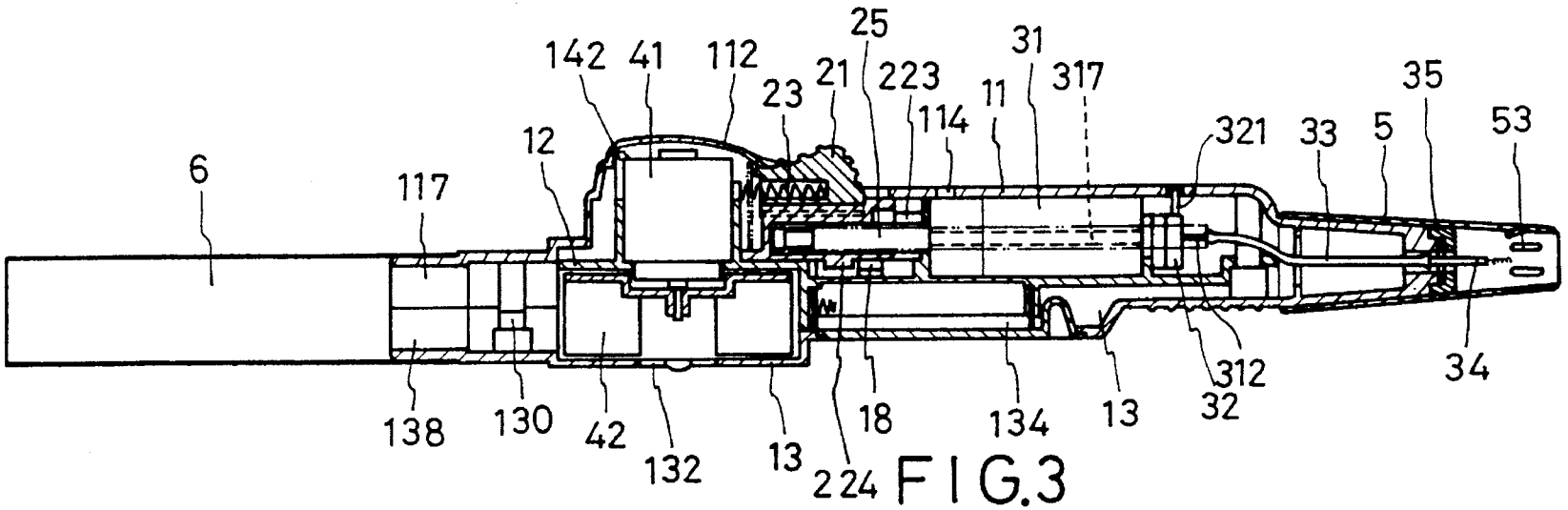
FIG. 3 is a side assembly view in section of the ignition device shown in FIG. 1.
Figure 4:
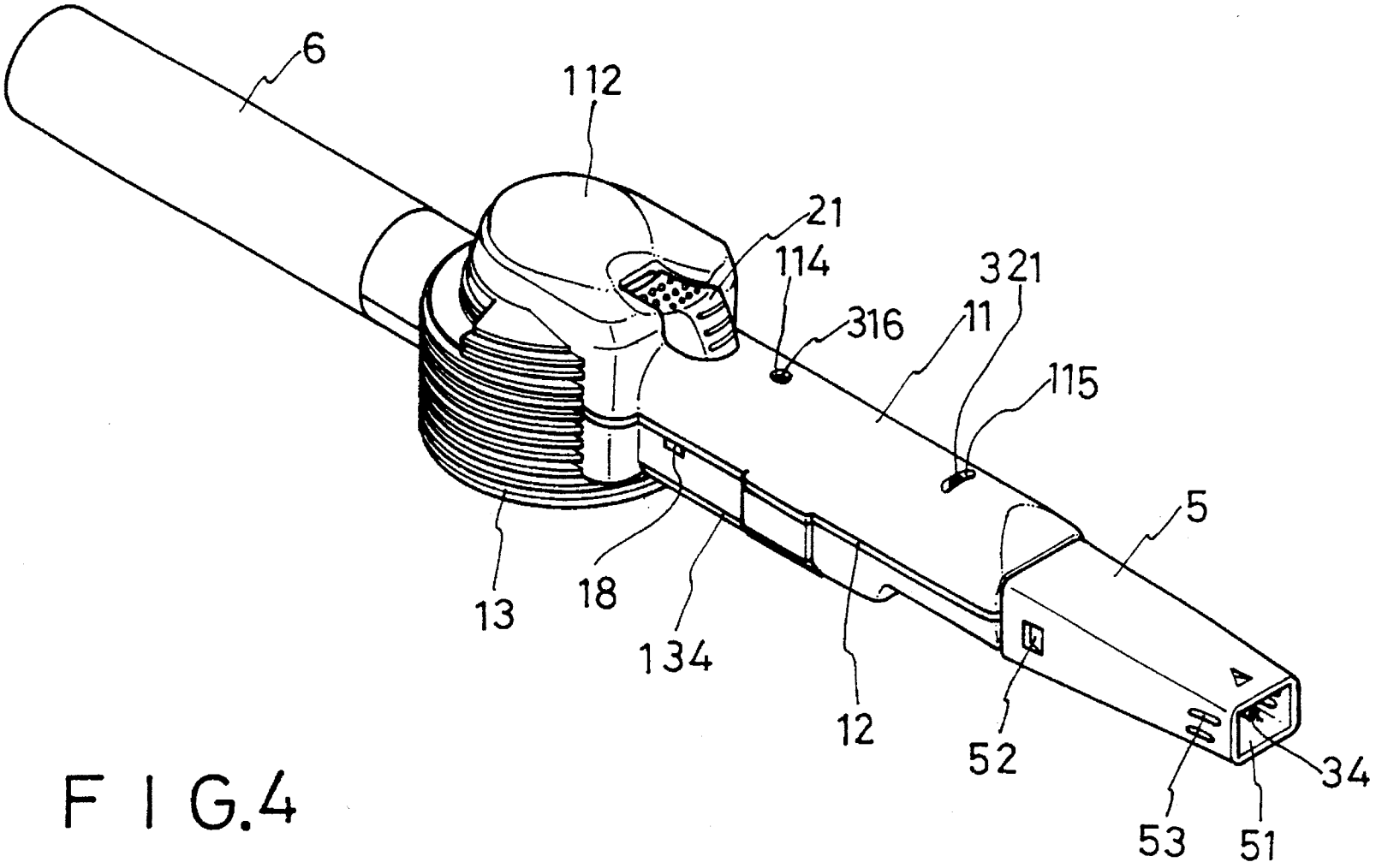
FIG. 4 is a plan view of the assembled structure of the preferred embodiment.

The sliding control key device 2 comprises a push knob 21 having a bottom groove 211, a sliding key 22 having a rail 221 fitted into the bottom groove 211, a spring 23 having one end fastened to a rear hole 212 on the push knob 21 (see FIG. 3) and an opposite end stopped against the upright stop rod 145. The sliding key 22 further comprises a longitudinal chamber 222, a curved metal actuating rod 24 mounted in the longitudinal chamber 222 and having a front hole 241 coupled to the gas nozzle 312 of the fuel gas container 31, a piezoelectric device 25 mounted within the longitudinal chamber 222 and fastened to the curved metal actuating rod 24, a conductor 251 connected to the piezoelectric device 25, two opposite projecting rods 223 inserted into respective holes (not shown) on the fuel gas container 31, and a bottom projection 224 (see FIG. 3). The bottom projection 224 of the sliding key 22 is stopped against the raised stop portion 181 of the safety plate 18 when the ignition device is not operated. When to operate the ignition device, the safety plate 18 is moved sideways to release the raised stop portion 181 from the bottom projection 224, and therefore the sliding key 22 can be moved by the push knob 21.

The gas release device 3 comprises a fuel gas container 31, an adjustment ring 32, a gas tube 33, a flame nozzle 34, and a fully-clay holder ring 35. The fuel gas container 31 comprises a front mounting groove 311 fastened to the curved mounting strip 127, a front gas nozzle 312, a retainer ring 313 securely fixed to the front gas nozzle 312 and connected to the front hole 241 on the curved metal actuating rod 24, two opposite rear holes 314, which receive the projecting rods 223 of the sliding key 22, a bottom hole 315, which receives the upright locating rod 126 of the partition plate 12, a fuel gas filling valve 316 inserted into the through hole 114 on the upper shell 11, and a longitudinal side groove 317, which receives the conductor 251 (see Figure 3). The adjustment ring 32 is mounted around the front gas nozzle 312, having an adjustment lever 321 extended out of the adjustment hole 115 on the upper shell 11 for adjusting the flow rate of the front gas nozzle 312. The gas tube 33 has one end connected to the front gas nozzle 312 and an opposite end connected to the flame nozzle 34, The flame nozzle 34 and the conductor 251 are inserted through the center through hole 351 on the fully-clay holder ring 35. The fully-clay holder ring 35 is fixedly secured to the front socket 5 on the inside.

The fan device 4 comprises a motor 41 mounted in the bottom chamber 111 of the upper shell 11 within the endless upright wall 14, and a fan blade 42 mounted within the top chamber 131 of the bottom shell 13. The motor 41 has an output shaft 411 inserted through the axle hole 143 on the partition plate 12 and fixed to the center coupling hole 421 on the fan blade 42. When the motor 41 is started, the fan blade 42 is rotated to draw air into the housing 1 through the air input port 132, permitting the input currents of air to be delivered out of the housing 1 through the air output port, which is defined within the rear half-round projections 117 and 138.

The front socket 5 is mounted around the front projections 116 and 137 of the upper and bottom shells 11 and 13, having a longitudinal through hole 51 gradually reduced toward the front end, two opposite retaining strips 52 fastened to respective retaining portions (not shown) on the front projections 116 and 137, and a plurality of air vents 53 for guiding outside air into the longitudinal through hole 51.

The extension tube 6 is mounted mounted the rear half-round projections 117 and 138 for guiding the flow of air from the fan blade 42 to the article burnt to accelerate its burning.

Figure 2:
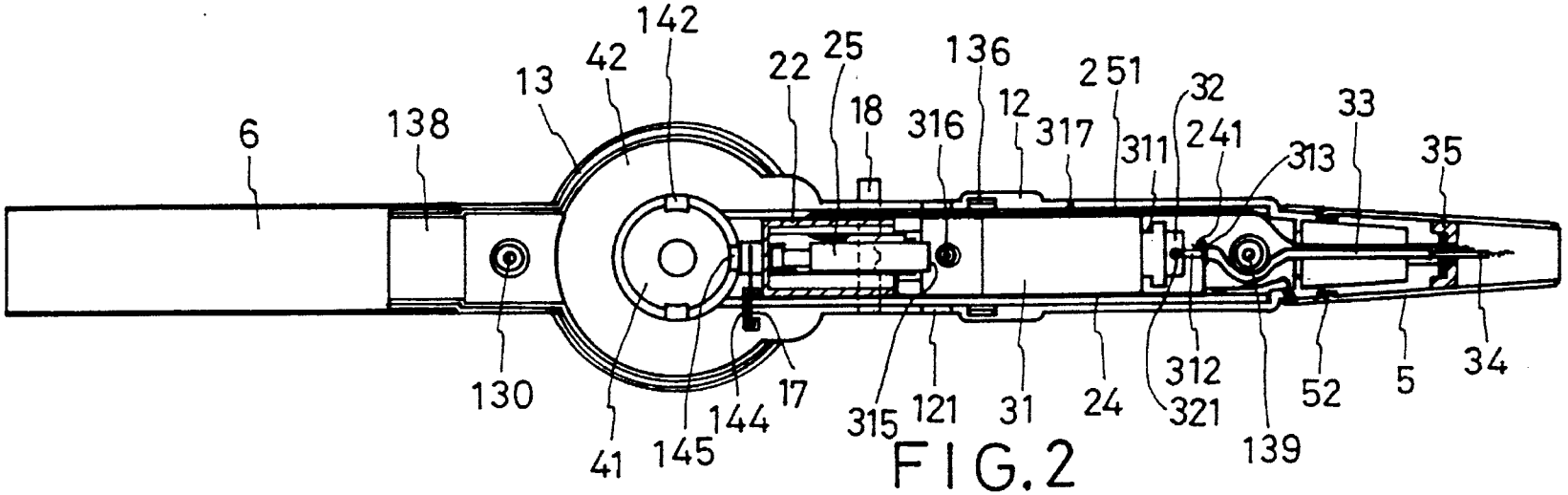
FIG. 2 is a top assembly in section of the ignition device shown in FIG. 1.

The assembly process of the ignition device is outlined hereinafter with reference to FIGS. 2 and 3 again. When the two opposite ends of the safety plate 18 are respectively inserted through the spaces 124 and the side notches 125, the safety plate 18 can be be moved back and forth in the transverse direction. Then, the gas nozzle 312 is fastened to the fuel gas container 31, and then the adjustment ring 32 is coupled to the gas nozzle 312, and then flame nozzle 34 is connected to the gas nozzle 312 by the gas tube 33, and then the holder ring 35 is fixed to the socket 5. The, the push knob 21 and the sliding key 22 are coupled together, and then the spring 23 is fastened to the rear hole 212 on the push knob 21. Then, the actuating rod 24 and the piezoelectric device 2 are mounted in the longitudinal chamber 222 of the sliding key 22, and then the projecting rods 223 of the sliding key 22 are respectively inserted into the rear holes 314 on the fuel gas container 31. Then, the front mounting groove 311 and the bottom hole 315 of the fuel gas container 31 are respectively fastened to the curved mounting strip 127 and the upright locating rod 126 of the partition plate 12. When the fuel gas container 31 is installed, the sliding control key device 2 and the gas release device 3 are supported on the partition plate 12, the sliding key 22 can be moved along the ribs 123, the spring 23 is stopped against the upward stop rod 145. Then, the flame nozzle 34 and the conductor 251 are inserted through the center hole 351 on the fully-clay holder ring 35, and then the socket 5 is fastened to the front projections 116 and 137. Then, the extension tube 6 is fastened to the rear half-round projections 117 and 138, and then the battery set is installed in the battery chamber 122 and the battery lid 134 is covered on the opening 133. Then, the upright mounting rods 130 and 139 of the bottom shell 13 are fastened to the upper shell 11 by a respective screw.

When in use, the safety plate 18 is moved sideways to release the raised stop portion 181 from the bottom projection 224 of the sliding key 22. When the safety plate 18 is released from the bottom projection 224 of the sliding key 22, the thumb can then moved along the slope 12 to push the push knob 21, causing it to move the sliding key 22 forwards. When the sliding key 22 is moved forwards, the piezoelectric device 25 is compressed, causing the conductor 251 to emit static sparks. At the same time, the actuating rod 24 is simultaneously moved forwards to release the gas nozzle 312, permitting fuel gas to be delivered out of the flame nozzle 34 through the gas tube 33 and burnt outside the flame nozzle 34 by the sparks for burning an article. When the thumb is released from the push knob 21, the piezoelectric device 25 is moved back to its former position, causing the actuating rod 24 released by the sliding key 22 from the the gas nozzle 312, therefore the gas nozzle 312 is closed, and the flame is extinguished.

When the article is burning, the push knob 21 can be moved in the reversed direction to push the L-shaped metal spring plate 17 backwards, causing the contact end 171 of the L-shaped metal spring plate 17 to contact the corresponding contact on the motor 41, and therefore the fan blade 42 is turned by the motor 41 to draw air from the air input port 132 through the extension tube 6 for accelerating the burning of the article. When the thumb is released from the push knob 21, the spring 23 immediately pushes the push knob 21 back to its former position, and therefore the motor 41 is turned off, and the fan blade 42 is stopped.

It is to be understood that the drawings are designed for purposes of illustration only, and are not intended as a definition of the limits and scope of the invention disclosed.

I claim:

1. An ignition device comprising:

a housing, said housing comprising an upper shell, a bottom shell fastened to said upper shell, and a partition plate longitudinally connected between said upper shell and said bottom shell;

a gas release device mounted within said housing controlled to release a fuel gas for burning, said gas release device comprising a fuel gas container having a gas nozzle, a flame nozzle, and a gas tube connected between said flame nozzle and said gas nozzle;

a sliding control key device mounted on said housing and controlled to drive said gas release device, causing said gas release device to release said fuel gas, and to produce static sparks for burning said fuel gas, said sliding control key device comprising a push knob, a sliding key coupled to said push knob and moved to drive said gas release device and having a longitudinal chamber, an actuating rod mounted in said longitudinal chamber, a piezoelectric device mounted in said longitudinal chamber and controlled by said actuating rod to release static sparks through a conductor for burning said fuel gas to make a flame; and a fan device mounted within an upright endless wall on said partition plate between said upper shell and said bottom shell, said fan device comprising a motor controlled by said sliding control key device and having an output shaft, and a fan blade coupled to said output shaft and driven to draw a flow of air into said housing, permitting said flow of air to be further guided out of said housing for accelerating the burning of the article which is burnt by said flame.

2. The ignition device of claim 1 wherein said upper shell comprises a front projection at one end matched with a respective front projection on said bottom shell, a half-round rear projection at an opposite end matched with a respective half-round rear projection on said bottom shell and connected with the half-round rear projection on said bottom shell to said extension tube, a bottom chamber, which receives said motor, a longitudinal sliding slot, which receives said sliding key, a top slope extended backwardly upwards from said longitudinal sliding slot for placing the thumb, an adjustment hole in front of said longitudinal sliding slot for passing the control lever of an adjustment ring which controls the flow rate of said gas nozzle, a through hole spaced between said longitudinal sliding slot and said adjustment hole through which a fuel gas filling valve which is installed in said fuel gas container projects, and two opposite bottom hooks respectively hooked on respective retaining holes on said partition plate.

3. The ignition device of claim 1 wherein said partition plate comprises a first pair of opposite retaining holes at two opposite sides respectively hooked up with the bottom hooks on said upper shell, a battery chamber to hold a battery set, two contact metal strips fixed to said battery chamber at two opposite ends and respectively connected to the two opposite terminals of said battery set, a plurality of ribs disposed in front of said endless upright wall for guiding said sliding key, two side notches, a safety device mounted between said side notches and moved transversely between the operative position to stop said sliding key and the non-operative position to release from said sliding key for permitting said sliding key to be driven by said push knob, a L-shaped metal spring plate disposed outside said endless upright wall and having a contact spaced from a respective contact on said motor, and a second pair of retaining holes for mounting said bottom shell, one contact metal strip being connected between said metal spring plate and a respective contact of said motor by conductors.

4. The ignition device of claim 2 wherein said partition plate further comprises an endless upright wall connected to said upper shell to hold said motor, an upward stop rod upwardly extended from said endless upright wall, an axle hole within said endless upright wall through which said output shaft of said motor extends outside said partition plate, a channel-like upright support disposed at one side by said endless upright wall to hold said L-shaped metal spring plate, permitting said L-shaped metal spring plate to be forced by said sliding key into contact with the respective contact on said motor in turning on said motor.

5. The ignition device of claim 1 wherein said bottom shell comprises a top chamber to hold said fan blade, an air input port through which air is drawn into said housing by said fan blade, an opening corresponding to said battery chamber and closed by a battery lid, a front projection matched with the front projection of said upper shell, a front upright mounting rod and a rear upright mounting rod respectively fixed to said upper shell by a respective screw, two upright hooks respectively hooked on the second pair of opposite retaining holes on said partition plate, a rear half-round projection matched with the rear half-round projection of said upper shell, two opposite side notches corresponding to the side notches on said partition plate for mounting said safety plate.

6. The ignition device of claim 5 further comprising a socket fastened to the front projections of said upper shell and said bottom shell to hold a fully-clay holder ring, which holds said flame nozzle in place, said socket having air vents for letting outside air in.

7. The ignition device of claim 5 further comprising an extension tube connected to the half-round rear projections of said upper shell and said bottom shell for guiding said flow of said from said fan blade out of said housing.

8. The ignition device of claim 1 wherein said push knob has a bottom groove for coupling to said sliding key; said sliding key has a rail fitted into said bottom groove of said push knob.

9. The ignition device of claim 8 wherein said said push knob has a rear hole and a spring having one end fastened to said rear hole and an opposite end stopped against an upright stop rod on said partition plate.

10. The ignition device of claim 1 wherein said sliding key has two longitudinal projecting rods respectively inserted into respective holes on said fuel gas container.

11. The ignition device of claim 3 wherein said sliding key has a bottom projection, which stops at said safety plate when said safety plate is moved to the operative position.

12. The ignition device of claim 2 wherein said gas release device further comprises an adjustment ring mounted on said gas nozzle, and a control level extended from said adjustment ring out of the adjustment hole on said upper shell for turning said adjustment ring to regulate the flow rate of said gas nozzle.

* * * * *